United States Patent [19]

Langkamp, Jr.

[11] Patent Number: 4,890,869

[45] Date of Patent: Jan. 2, 1990

[54] OVER-CENTER DRAW LATCH

[75] Inventor: Richard B. Langkamp, Jr., Rochester, N.Y.

[73] Assignee: Southco, Inc., Concordville, Pa.

[21] Appl. No.: 248,336

[22] Filed: Sep. 20, 1988

Related U.S. Application Data

[63] Continuation of Ser. No. 32,736, Mar. 31, 1987, abandoned.

[51] Int. Cl.[4] ..... F05C 3/03

[52] U.S. Cl. ..... 292/113; 292/247; 292/103

[58] Field of Search ..... 292/247, 256.69, 113, 292/103; 24/453, 637, 617

[56] References Cited

U.S. PATENT DOCUMENTS

| | | | |
|---|---|---|---|
| 2,462,282 | 2/1949 | Pickford | 292/113 |
| 3,008,320 | 11/1961 | Cheney | 292/113 |
| 3,008,745 | 11/1961 | Cheney | 292/113 |
| 3,030,137 | 4/1962 | Cheney | 292/113 |
| 3,134,617 | 5/1964 | Slonneger | 292/113 |
| 3,145,038 | 8/1964 | Swanson | 292/113 |
| 3,174,784 | 3/1965 | Swanson | 292/113 |
| 3,287,775 | 11/1966 | Eubank | 24/637 |
| 3,321,230 | 5/1967 | Stollman | 292/113 |
| 3,428,348 | 2/1969 | Swanson | 292/113 |
| 3,534,992 | 10/1970 | Swanson | 292/247 |
| 3,618,995 | 11/1971 | McLean | 292/113 |
| 3,847,423 | 11/1974 | Gley | 292/DIG. 49 |
| 3,936,082 | 2/1976 | Swanson | 292/DIG. 49 |
| 4,300,794 | 11/1981 | Dunsmoor | 292/DIG. 49 |
| 4,326,739 | 4/1982 | Schlueter | 292/247 |
| 4,367,569 | 1/1983 | Harmon | 24/453 |
| 4,522,436 | 6/1985 | Hoen et al. | 292/113 |

FOREIGN PATENT DOCUMENTS

| | | | |
|---|---|---|---|
| 549989 | 12/1922 | France | 292/247 |
| 481801 | 1/1970 | Switzerland | 292/256.69 |

OTHER PUBLICATIONS

Southco, Inc. Over-center Draw Latch, pp. H-4 and H-5.

*Primary Examiner*—Gary L. Smith
*Assistant Examiner*—Eric K. Nicholson
*Attorney, Agent, or Firm*—Paul & Paul

[57] ABSTRACT

A draw latch is provided, of the over-center type, in which the latch has a base, a lever and a catch. The base and lever are pivotally connected to each other, and the catch and lever are pivotally connected to each other. The catch preferably has a lip or hook at its end, for engagement with a member that is to be drawn toward engagement with another member upon which the base is mounted, for drawing those members together, as the lever is moved from an open position to a closed position, through which movements the over-center motion is effected. Dimples or detents are used to provide a resistance to relative motion between the base and the lever on the one hand, and the lever and the catch on the other, through most of the range of their relative movements, but the detents become aligned or nested in one position for assembly of the components under non-frictional conditions, with the detents effecting a spring-like function upon legs of the lever.

11 Claims, 3 Drawing Sheets

OVER-CENTER DRAW LATCH

This application is a continuation, of application Ser. No. 032,736, filed 03/31/87, now abandoned.

BACKGROUND OF THE INVENTION

In the art of over-center draw latches, it is known to provide a draw latch having the components of a base, a lever and a catch, with the base and lever being pivotally connected to each other, and with the catch and lever being pivotally connected to each other, with such pivotal connections generally being at the locations of shafts.

Such prior art latches are highly desirable and effective. However, some users of the latches find it convenient that these pivot connections not be freely movable, so that the three basic components of the latch can be retained in open positions. To this end, there has been developed the technique of applying a plastic resistance member between the pivot shaft that exists for pivotally connecting the lever and base, and the pivot shaft that connects the lever and catch. This plastic member provides a sufficient functional resistance between these pivot shafts, that it will maintain the basic three components in various positions, relative to each other. However, such a plastic member comprises essentially a fourth component which can increase the cost and work of assembling the latch, and requires the riveting of the pin or shaft that forms the pivot connection between the base and lever to prevent its rotation and to prevent the consequent friction-free motion at that location that would otherwise occur without riveting that pin. This riveting also increases the cost and work of assembling the latch.

THE PRESENT INVENTION

The present invention is directed toward providing an improvement in the latches set forth above by adding a spring support or prevailing torque to both joints or pivot locations of the fastener. This will allow the various components of the latch to remain in various given positions, and will avoid a potential loss of frictional resistance due to accidental removal of a plastic friction part.

In the present invention, the addition of friction to the pivot locations or joints of the fastener is accomplished by providing dimples or detents in legs of the base that engage against legs of the lever during most positions of relative movement therebetween, actually bending the lever legs inwardly, which, in turn, effects a resistance at the location of pivoting between the legs of the lever and the catch, by effecting a binding of the legs against a cylindrical portion of the catch during its pivoting movement. This binding is effected by springing the legs of the lever inwardly toward each other.

Additionally, there is provided a pair of dimples, detents or stakes, also extending inwardly toward each other, on the legs of a lever member, which, in one position of the lever member relative to the pivot pin connecting it with the legs of the base, will align or nest with the dimples or detents of the base, thereby providing a position in which the base and lever are not subjected to a spring support or prevailing torque, in which position they are in anti-friction pivot engagement. In this antifriction pivot engagement, the components of the latch may more readily be assembled without contending with frictional resistance.

The present invention thereby eliminates a plastic component, but still provides a frictional resistance in both pivots, to hold the components of the latch in an open position. The present invention also provides a uniform frictional resistance that is independent of the locking forces which may be applied to the latch. Additionally, the present invention, not having a plastic friction member used with it, eliminates the inherent compression of the plastic member under load when the latch is closed, thereby eliminating the inherent delay in recovery of the plastic before it provides the usual degree of frictional resistance after load.

SUMMARY OF THE INVENTION

An over-center draw latch is provided, having a base, a lever and a catch, with the base and lever being pivotally connected to each other and with the catch and lever being pivotally connected to each other, with a resistance being provided between the base and the lever, for effecting frictional resistance against relative movement therebetween, and preferably with a frictional resistance being provided between the lever and catch, also for effecting frictional resistance therebetween, such that a range of movement between the components is provided with frictional resistance.

Accordingly, it is a primary object of this invention to provide a novel over-center draw latch having frictional resistance between the relative pivotal components.

It is another object of this invention to accomplish the above object, wherein there is at least a single position of relative movement between the several components, in which there is no substantial frictional resistance between them.

It is a further object to accomplish each of the objects above, wherein the frictional resistance is accomplished by means of detents or dimples in one or more of the components, engageable against portions of the other components.

It is a further object of the present invention to accomplish each of the objects set forth above, wherein the provision of resistance is effected without the addition of extra parts in the assembly.

Other objects and advantages of the present invention will be readily apparent to those skilled in the art from a reading of the brief descriptions of the drawing figures, the detailed description of the preferred embodiment, and the appended claims.

BRIEF DESCRIPTIONS OF THE DRAWING FIGS.

DETAILED DESCRIPTION OF THE PREFERRED EMBODIMENT

Figure 1:
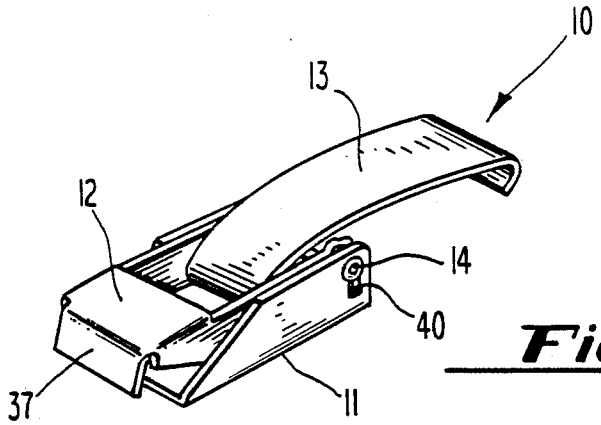
FIG. 1 is a top perspective view of an over-center draw latch in accordance with the present invention, with the components of the latch in a closed, or latched condition.

Referring now to the drawings in detail, reference is first made to FIG. 1, wherein there is illustrated a latch generally designated by the numeral 10, as comprising a base 11, a lever 12, and a catch 13. The base 11 and lever 12 are mounted for pivotal movement therebetween by means of a pivot pin or shaft 14 extending therebetween. The pivot pin 14 extends between upstanding legs 15 and 16, as shown, and need not be tightly riveted thereto, but may, if desired, be freely rotational relative to the legs 15 and 16, but will generally have enlarged ends 17 and 18, to be secure endwise against discharge from the legs 15 and 16. The legs 15 and 16 have chamfered corners 20 and 21, as shown, for ease of manually grasping the lever 12 for opening the same. A flat bottom 22 is provided for the base, connecting the legs 15 and 16. A pair of mounting holes 23, 24 are provided in flat plate 22, for attaching the base 11 to an article 24, to which it is to be mounted, by means of screws (not shown) or the like.

Figure 2:
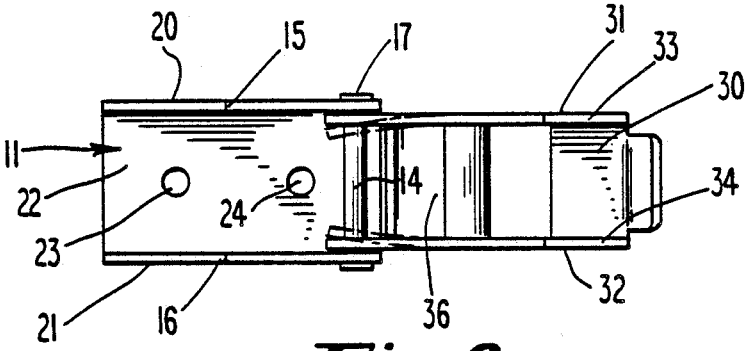
FIG. 2 is a top view of the latch of FIG. 1, with the components of the latch in an open position in which the lever has been pivoted about 180° from the position of the lever illustrated in FIG. 1.

The lever member 12 is likewise provided with a plate member 30, from which extend upstanding legs 31, 32, as seen in FIG. 2, with chamfered ends 33, 34. The legs 31, 32 of lever member 12, at their left ends as viewed in FIG. 2, are engaged with the pin 14 as shown, with the pin extending through the legs, for pivoting of the legs 31, 32 relative to the pin 14, as the lever is moved between open and closed positions. The legs 31, 32 of the lever 12 also carry a pin or shaft 35, therebetween, about which there is mounted cylindrical pivot portion 36 of the catch 13, for pivotal movement of the catch 13 relative to the lever 12. The lever 12 is provided with a downwardly depending lip 37, as illustrated in FIG. 1, conforming to the general smooth contour of the latch as illustrated in FIG. 1, although, if desired, the lip 37 could be upwardly bent, for facilitating manually grasping the same.

The catch 13 is constructed to be spring-like, and is provided with a hook 38 at its outer end remote from the cylindrical pivot portion 36.

Figure 4:
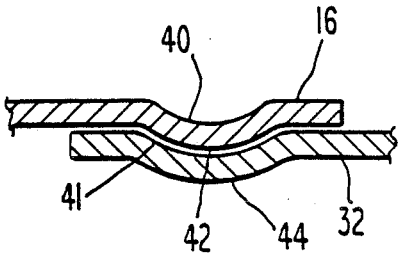
FIG. 4 is an enlarged fragmentary detail view, in section, of the nested relationship of two dimpled portions of the base and lever, in substantially friction-free engagement, taken generally along the line of IV—IV of FIG. 3.

Legs 16 and 32 of the base and lever, respectively, are each provided with inwardly facing detents, dimples, or recesses 40, 41 as shown, capable of nesting together in a given relative pivotal position of the base and lever, such as that of the illustration of FIG. 4, in which there is substantially no spring support or prevailing torque, or resistance to pivoting. In the nested position of these detents 40, 41, the legs 31, 32 of the lever 12 are in the straight line position therefor illustrated in FIG. 2, as distinguished from the inwardly frictionally urged phantom positions therefor also illustrated in FIG. 2.

Figure 3:
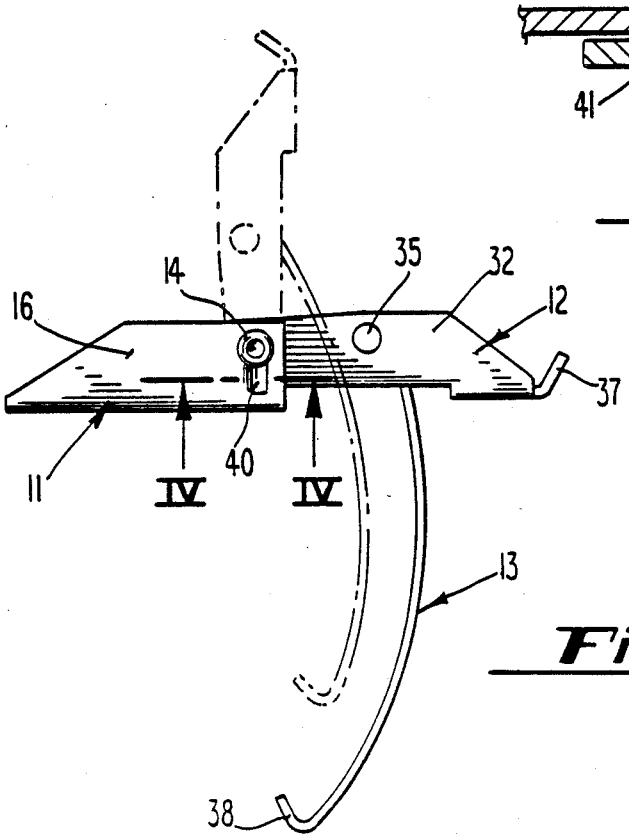
FIG. 3 is a side view of the latch of FIG. 2, also illustrating the lever and catch in phantom in half-closed positions.
Figure 5:
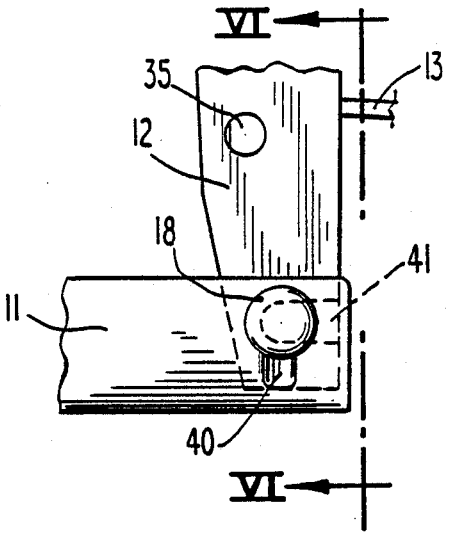
FIG. 5 is an enlarged fragmentary detail view of portions of the lever and base in half-closed relative positions, with their respective detents in positions for effecting relative friction between the components.
Figure 6:
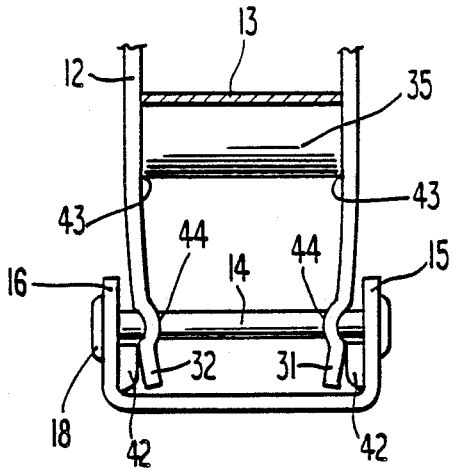
FIG. 6 is an enlarged fragmentary detail view of a right end view of the apparatus illustrated in FIG. 5, taken generally along the line of VI—VI of FIG. 5, and wherein the use of one set of dimples to effect a binding of the legs of the lever, is illustrated.

With reference now to FIGS. 5 and 6, it will be seen that when the lever 12 is moved to another position, different from that in which the detents 40, 41 are nested, such as with the lever 12 moved counterclockwise approximately 90° from the position of the lever illustrated in FIG. 3, the detents 40, 41, are out of nested position, not aligned with each other, as illustrated, In such position the inwardly facing protrusions 42 that are formed upon formation of the detents 40 engage the lower ends of the legs 31, 32 of the lever, and bend the same inwardly toward each other as illustrated in exaggerated form in FIG. 6, sliding toward each other somewhat along the pin 14, so as to frictionally engage the cylindrical portion 36 of the catch 13, in binding relation at locations 43, as shown, thereby offering a frictional resistance between the legs 31, 32 and the cylindrical portion 36, that opposes relative pivoting between the catch 13 and lever 12. Similarly, the protrusions 42 provide a frictional resistance to relative movement between the base 11 and lever 12, by creating a sliding friction between such protrusions 42 and the lower ends of legs 31, 32, as shown.

It will be seen that inwardly facing protrusions 44, in legs 31 and 32, like the protrusions 42, are formed to protrude outwardly by the dimpling or recessing upon the creation of the detents 41, as shown.

Figure 7:
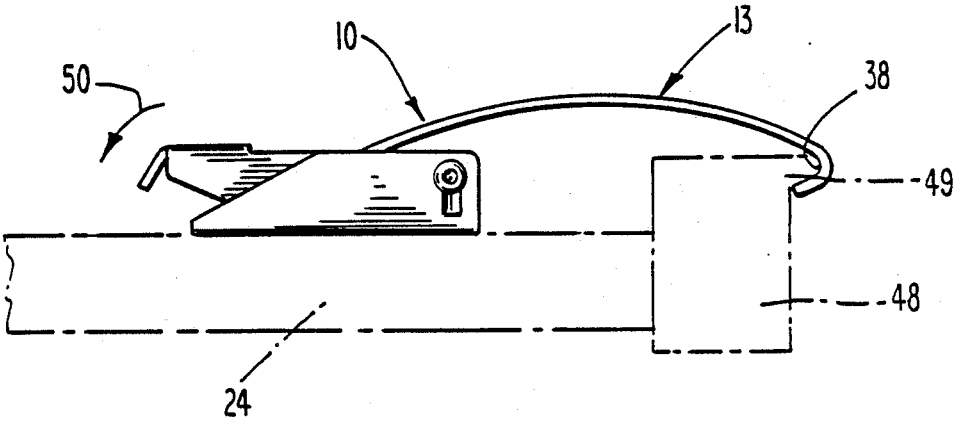
FIG. 7 is a side elevation of the latch of FIG. 3, similar to that of FIG. 3, but with the latch in its closed condition, and with a pair of phantom-illustrated components upon which the base is mounted and the outer end of the catch is engaged, for securing those components together.

With reference to FIG. 7, there is shown the manner in which, for example, a cover 48 may be clamped to a sidewall 24 of a box or the like, by using the over-center draw latch 10 of the present invention, whereby hook-like engagement end 38 will engage against a lip 49 of the cover, and draw the same toward the sidewall 24, as the lever is moved toward a closed position such as that illustrated by the arrow 50 in FIG. 7. In such closed position, the catch 13 will be functioning in spring-like manner, holding the lid thus closed.

Figure 8:
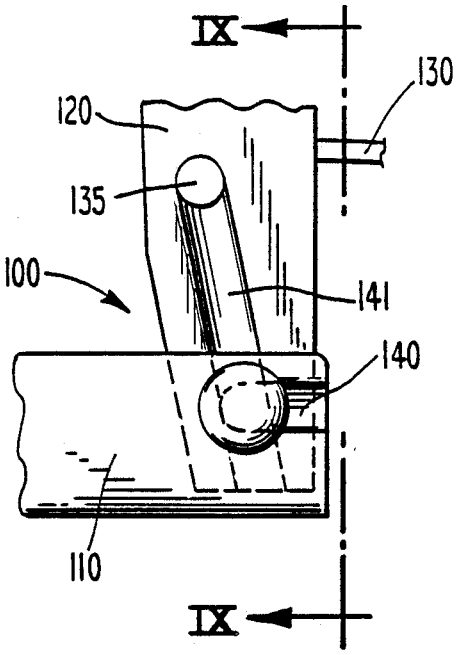
FIG. 8 is a view similar to that of FIG. 5, but of an alternative embodiment of the invention.
Figure 9:
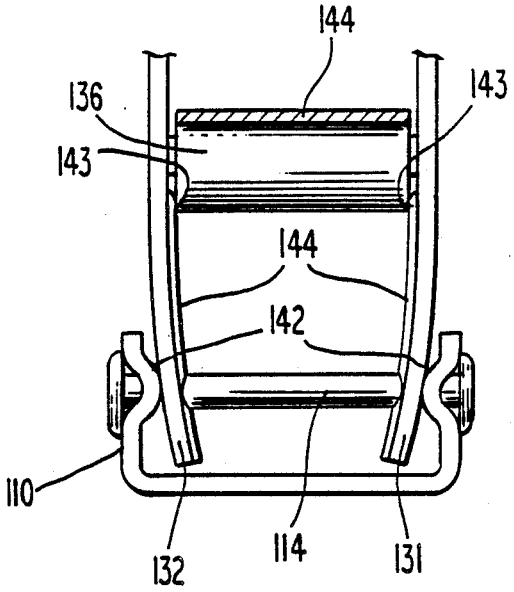
FIG. 9 is a view similar to that of FIG. 6, but of the embodiment of FIG. 8, taken along line IX—IX of FIG. 8.

Referring now to FIGS. 8 and 9, it will be seen that the alternative embodiment of the latch 100 has a base 110, a lever 120 and a catch 130 but and detents 140 and 141 forming inwardly facing protrusions 142 and 144, respectively, with the protusions 142 engaging the legs 131, 132 as shown, similarly bending them inwardly as with respect to FIG. 6, to slide toward each other somewhat along the pin 114 so as to frictionally engage the cylindrical portion 136 of the catch 130 in binding relation at locations 143, as shown, thereby providing the frictional resistance between the legs 131, 132 and cylindrical portion 136, that opposes relative pivoting between the catch 130 and lever 120. Similarly, the protusions 142 provide a frictional resistance to relative movement between the base 110 and lever 120, by creating a sliding friction between such protusions 142 and the lower ends of legs 131, 132, as shown.

The inwardly facing protusions 144, in legs 131 and 132, like the protusions 142, are formed to protude by the dimpling or recessing upon the creation of the detents 141, as shown. It will be noted that the detents 141 are elongated, and essentially run from the shaft 135 through the lower ends of the legs 131, 132, as shown.

In the embodiment of FIGS. 8 and 9, the detents provide two positions of zero frictional resistance of the lever with respect to the base; namely when the detents 140 and 141 are aligned, which occurs when the lever 120 is moved 90° rightward from its position illustrated in FIG. 8, with the base 110 in the same position shown in FIG. 8, and also when the lever 120 is moved 90° leftward such that the lever and base assume postures more similar to those illustrated for the embodiment illustrated in FIG. 7. This provides increased versatility of the latch, in that it allows the hook end of the catch to engage a keeper located below the plane of the base, by not restricting the downward swinging of the catch 130 when the lever is in the locked position (not shown).

Additionally, if desired, slight depressions may be made in the ends of the tubular portion 136 of the catch 130, but such depressions (not shown) are not essential. If such depressions are provided, they will generally be located so that when the latch 100 is in a latched position similar to that of FIG. 7, such depressions will be aligned with those portions of the detents 143 that are closest to the pivot 135 such that, when the lever 120 is in a locked position, there will be provided a position of zero frictional resistance at locations 143, but with a range of positions of frictional resistance between the catch and lever when the lever is in the locked position, such range of positions occurring when the catch 130 is lifted upward somewhat from the latched position.

It will thus be apparent that FIGS. 8 and 9 illustrate another embodiment of the invention within the spirit and scope of the appended claims.

It will be apparent from the foregoing that various modifications may be made in the details of construction, as well as in the use and operation of the device of the present invention, all within the spirit and scope of the invention as claimed.

What is claimed is:

1. An over-center draw latch of the type comprising a base, a lever and a catch, with the base and lever being pivotally connected to each other for relative movement through a predetermined angular range and with the lever and catch being pivotally connected to each other, the improvement comprising lever resistance means disposed between and comprising at least one detent portion of any of said base and said lever and formed integrally as one piece therewith for providing frictional resistance against relative movement therebetween, through most of the predetermined range of angular positions thereof, including catch resistance means for providing frictional resistance between said lever and catch.

2. The latch of claim 1, wherein the lever includes legs pivotally carried relative to said base and with said catch being pivotally carried in a pivot connection between said legs, and with both said lever resistance means and catch resistance means including means for urging movement of said legs relative to each other and for bending said legs toward a frictional engagement at said pivot connection between said legs.

3. The latch of claim 1, wherein there is at least one arrangement of relative pivotal positions among said base and lever and catch when said frictional resistance between the base and lever is substantially inoperative in which relative movement therebetween is substantially unrestrained.

4. The latch of claim 1, wherein said lever resistance means comprises detent means in both of said base and lever.

5. The latch of claim 4, wherein there is at least one arrangement of relative pivotal positions among said base, lever and catch when said frictional resistance between said lever and catch is substantially inoperative in which relative movement therebetween is substantially unrestrained.

6. The latch of claim 5, wherein in the inoperative position of said frictional resistance between said lever and catch, the said detent means in both said lever and base are aligned in substantially nested relationship.

7. The latch of claim 5, wherein in the operative position of said frictional resistance between said lever and catch, the said detent means in both said lever and base are unaligned and are in unaligned frictional interengagement with each other.

8. The latch of claim 1, wherein the lever includes legs pivotally carried relative to said base and with said catch being pivotally carried in a pivot connection between said legs, and with both said lever resistance means and catch resistance means including means for urging movement of said legs relative to each other and for bending said legs toward a frictional engagement at said pivot connection.

9. The latch as in claim 1, wherein said catch is a spring-like member provided with a hook-like engagement end opposite its pivotal connection with said lever.

10. The latch of claim 8, wherein the inoperative positions of said frictional resistance between said base, lever and catch, the said detent means in both said lever and base are aligned in substantially nested relationship, wherein said catch is a spring-like member provided with a hooklike engagement end opposite its pivotal connection with said lever.

11. The latch as in claim 1, wherein said resistance means comprises means for applying a uniform frictional resistance independent of any locking forces that may be applied to the latch.

* * * * *